US007476134B1

(12) United States Patent
Fell et al.

(10) Patent No.: US 7,476,134 B1
(45) Date of Patent: Jan. 13, 2009

(54) JET POWERED STEERING SYSTEM FOR SMALL BOAT OUTBOARD MOTORS

(76) Inventors: William P. Fell, 549 W. Fireweed La., Anchorage, AK (US) 99503; William P. O'Hara, P.O. Box 521311, Big Lake, AK (US) 99652

( * ) Notice: Subject to any disclaimer, the term of this patent is extended or adjusted under 35 U.S.C. 154(b) by 769 days.

(21) Appl. No.: 10/696,418

(22) Filed: Oct. 29, 2003

(51) Int. Cl.
*B63H 11/00* (2006.01)

(52) U.S. Cl. ..... 440/38; 440/53

(58) Field of Classification Search ..... 440/38, 440/40, 41, 42, 43, 53
See application file for complete search history.

(56) References Cited

U.S. PATENT DOCUMENTS 3,071,102 A * 1/1963 Buehler ..... 440/41
3,089,454 A * 5/1963 Chronic ..... 440/41
3,782,320 A * 1/1974 Groves, Jr. ..... 440/41
3,842,787 A * 10/1974 Giacosa ..... 440/41
3,906,885 A * 9/1975 Woodfill ..... 440/42
5,967,868 A * 10/1999 Ito et al. ..... 440/111
6,062,922 A * 5/2000 Nanami ..... 440/38
6,695,657 B2 * 2/2004 Hattori ..... 440/84
2003/0032344 A1 * 2/2003 Blanchard ..... 440/38

* cited by examiner

*Primary Examiner*—Stephen Avila
(74) *Attorney, Agent, or Firm*—Michael J. Tavella

(57) ABSTRACT

A directional nozzle for the jet output that is attached to a control cable system. This cable turns the directional nozzle, which causes the trust of the jet output to turn the boat. Thus, the boat can be steered without having to turn the entire motor. Two different mechanisms are disclosed that enable the steering. The first is a tiller system that operates much like the traditional tiller on an outboard motor. However, unlike those tillers, this tiller operates the directional nozzle and does not turn the entire motor. The second mechanism is a bicycle handlebar system that is placed forward of the motor, much like a traditional wheel. The handlebar system, when combined with the directional nozzle system, produces faster steering response without the effort required to turn the wheel to make large sweeping turns.

3 Claims, 10 Drawing Sheets

JET POWERED STEERING SYSTEM FOR SMALL BOAT OUTBOARD MOTORS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to jet powered steering system for small boat outboard motors and particularly to jet powered steering system for small boats that steer without turning the outboard motor.

2. Description of the Prior Art

Outboard motors have been in use decades. These units have a small engine that is attached to a drive shaft, which in turn, drives a propeller or jet drive. The output of these motors propels the boat forward. To turn the boat, the user must guide the output of the motor to one side of the stern. This is typically accomplished in one of two ways. The first uses a tiller arm that is directly attached to the motor. This system is usually found on smaller motors. It has an extended handle, usually with a throttle grip attached. The motor is secured to the transom of the boat on a pivot that allows the motor to be rotated about the pivot. This is done by moving the tiller handle from side to side. For larger boats, a steering wheel system is often used. The steering wheel is typically located forward in the boat and is connected to the motor by cables. As the steering wheel is turned, the steering wheel pulls the cables, which in turn, cause the motor to pivot about its pivot, thereby steering the boat.

The problem with this system is that it requires the entire motor to move. Besides the effort needed to move the motor, the amount the motor can turn is often limited by the space behind the transom. Moreover, turning the motor from one side of the boat to the other takes some time, especially for the steering wheel controls.

BRIEF DESCRIPTION OF THE INVENTION

The instant invention overcomes this problem by creating a directional nozzle for the jet output that is attached to a control cable system. This cable causes the directional nozzle to turn, which causes the trust of the jet output to turn the boat. Thus, the boat can be steered without having to turn the entire motor. Two different mechanisms are disclosed that enable the steering. The first is a tiller system that operates much like the traditional tiller on an outboard motor. However, unlike those tillers, this tiller operates the directional nozzle and does not turn the entire motor. The second mechanism is a bicycle handlebar system that is placed forward of the motor, much like a traditional wheel. The handlebar system, when combined with the new steering system, produces faster steering response without the effort required to turn the wheel to make large sweeping turns.

The system has a substantial advantage over standard steering systems. First, is speed of control. The boat turns much faster because the movement of the steering control is minimized. Second, the operation of the boat is optimized because the motor remains stationary, which helps maintain optimum water flow under the boat.

DETAILED DESCRIPTION OF THE INVENTION

Figure 1:
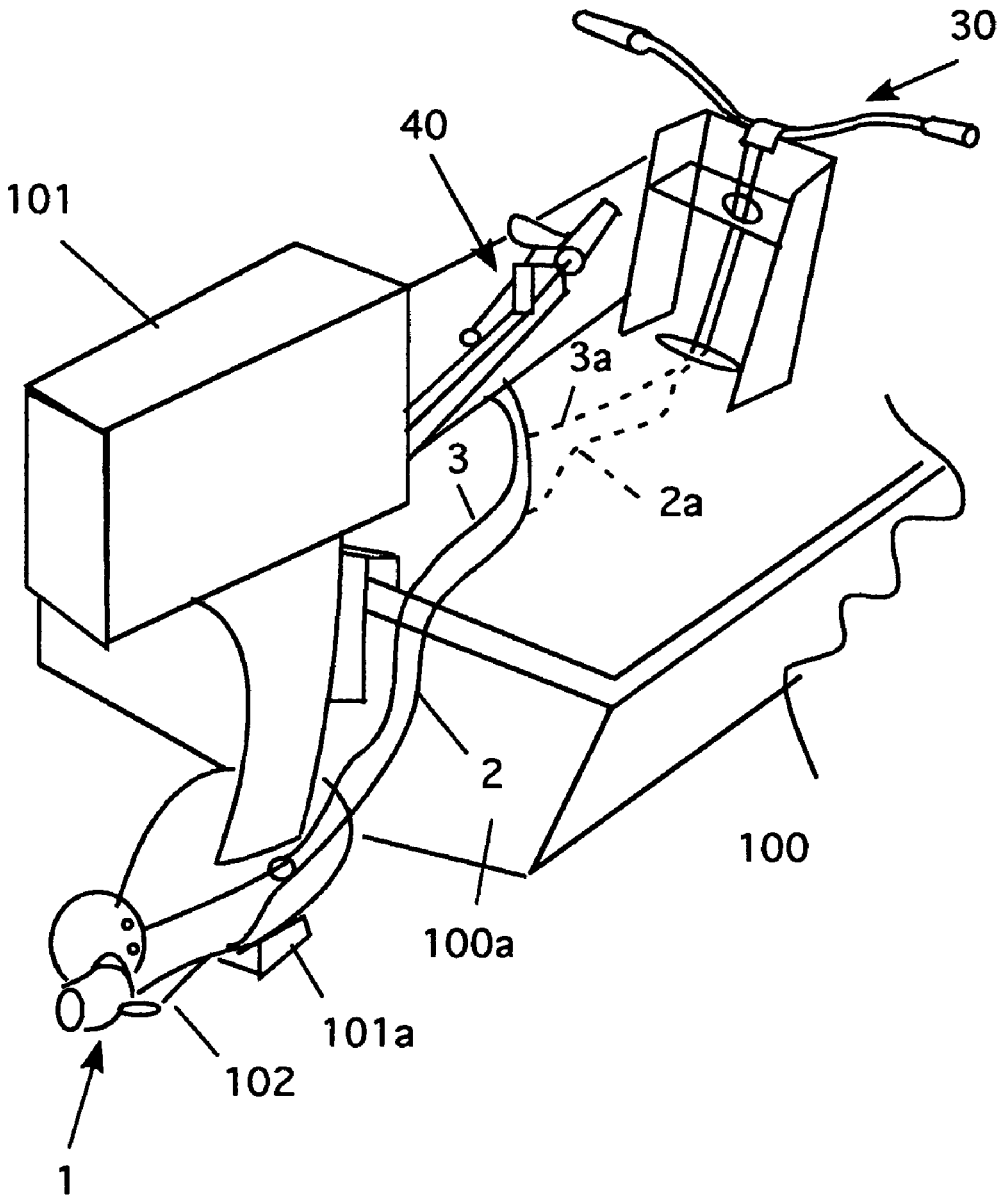
FIG. 1 is a detail view of the first embodiment of the invention, the jet pump steering system.

Referring now to FIG. 1, a detail view of the invention, the jet pump steering (JPS) system is shown. FIG. 1 shows a portion of a boat 100 that has a transom 100*a* on which an outboard motor 101 is mounted. The motor 101 has a jet pump drive 102 (see FIG. 2) on its lower unit 110*a*. The figure shows the JPS system 1 mounted to the lower unit 101*a* of the motor 101. Control cables 2 and 3 are shown running from the JPS system 1 to the control tiller 30. Dashed lines 2*a* and 3*a* are shown running to the optional handlebar steering system 40. Both the control tiller and the handlebar steering system are discussed in greater detail below.

Figure 2:
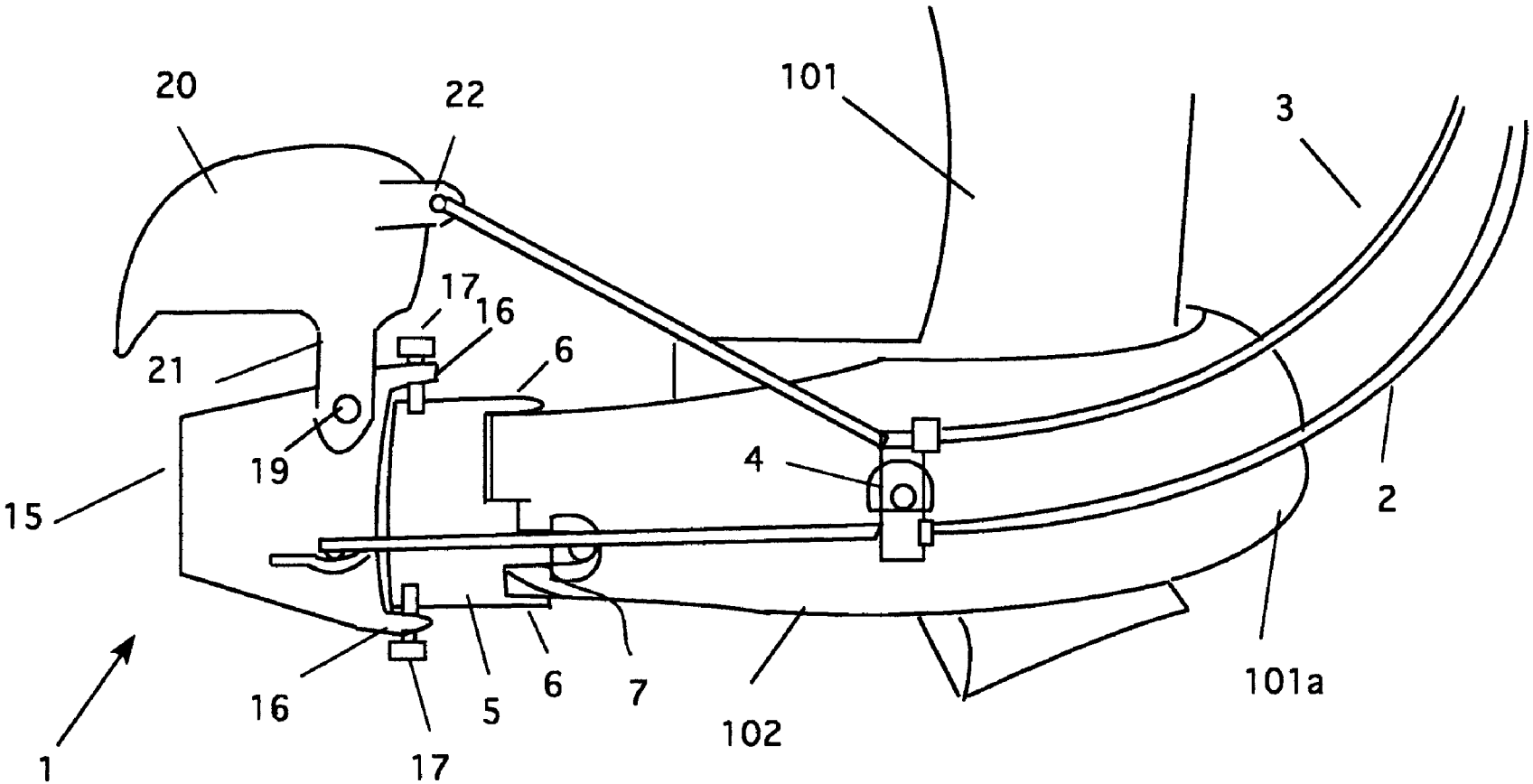
FIG. 2 is a side detail view of the jet pump steering system lower portion.

FIG. 2 is a side detail view of the JPS system 1. Here, the lower unit 110*a* of the motor 101 is shown. The jet pump output 102 extends out from the back of the lower unit 110*a*. The JPS has three main parts. First, there is an adaptor ring 5 (see FIG. 4). Next, there is a directional nozzle 15 (see FIG. 5) and then there is a reverse thrust cap 20 (see FIG. 6). When assembled, these components allow a user to steer a boat quickly and easily. Cables 2 and 3 are shown attaching to the directional nozzle 15 and to the reverse thrust cap 20. These connections are described in detail below. The cables also are held by bracket 4, which is secured to the lower unit 101*a*.

Figure 3:
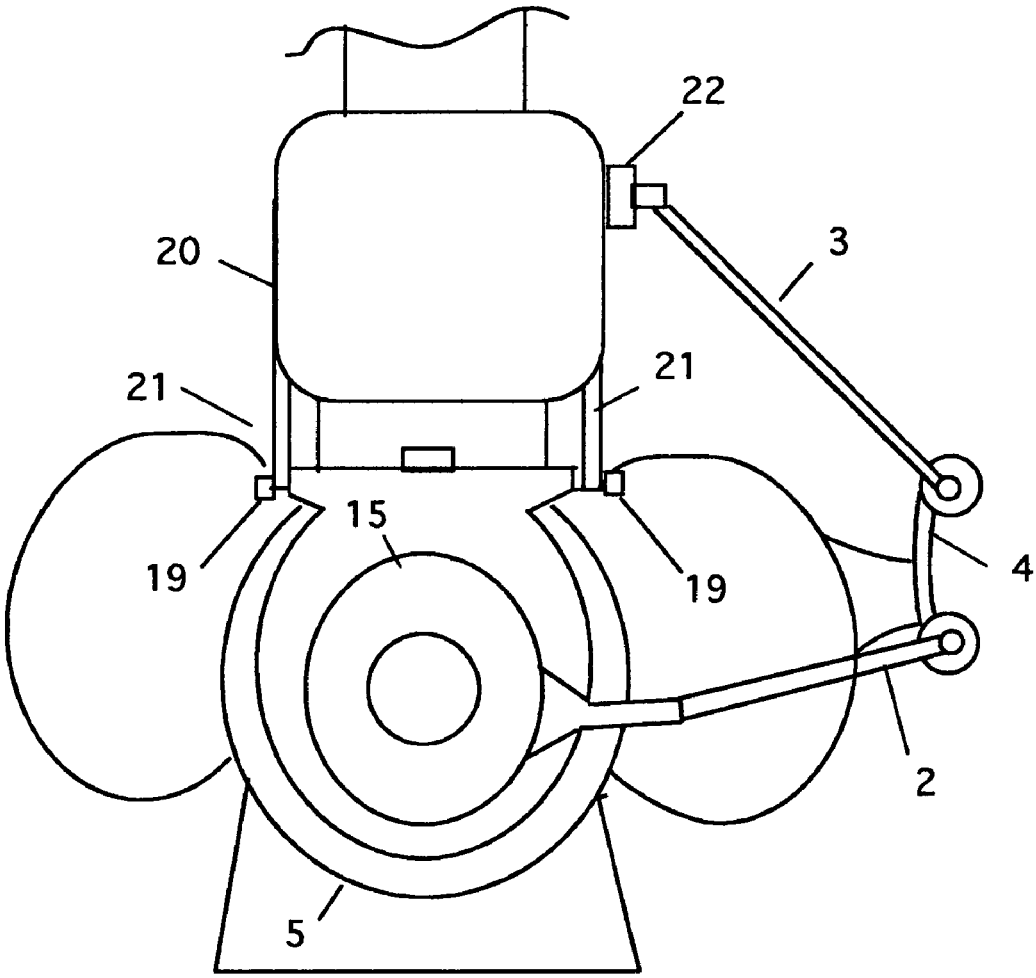
FIG. 3 is a rear view of the jet pump steering system lower portion, in place on a motor.

FIG. 3 is a rear view of the JPS system lower portion, in place on a motor. Here, the adaptor ring 5, the directional nozzle and reverse thrust cap are shown in relation to the lower unit 101*a* of the motor. Note the positions of cables 2 and 3 in making connections to the different components. Note also bracket 4, which is secured to the lower unit 101*a*. This bracket holds the cables 2 and 3 in the proper position.

Figure 4:
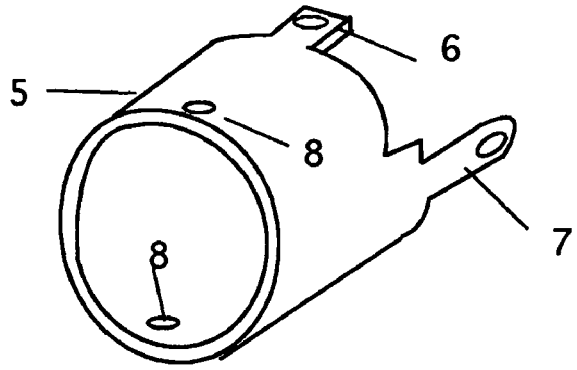
FIG. 4 is a perspective detail view of the adapter ring frame of the jet pump steering system.

FIG. 4 is a perspective detail view of the adapter ring frame of the JPS system. The adaptor ring 5 is used to attach the directional components of the JPS to the lower unit. The adapter ring 5 has two brackets 6 that connect the adapter ring to the lower unit 101*a*. See FIG. 2. The adapter ring 5 does not move after it is installed. Rather, it acts as a means for attaching the movable components of the system to the motor. The adapter ring 5 also has a bracket 7 that is used to secure the cable 2 as it feeds back to the directional nozzle 15. Finally, the adapter ring 5 has two holes 8 that are used to secure the directional nozzle 15, as discussed below.

Figure 5:
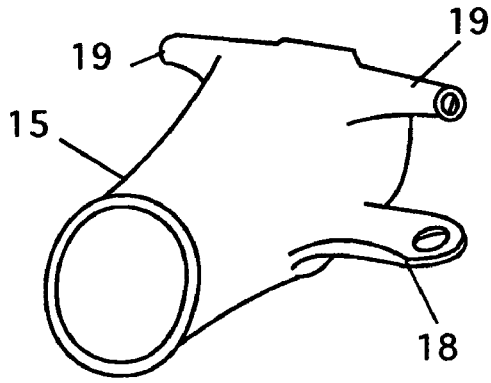
FIG. 5 is a perspective detail view of the directional nozzle of the jet pump steering system.

FIG. 5 is a perspective detail view of the directional nozzle of the JPS system. The directional nozzle 15 has a tapered body to allow for maximum efficiency in the jet flow. The directional nozzle 15 has two brackets 16 (see FIG. 2) that secure it to the adaptor ring 5 using bolts 17, or other common fasteners. A bracket 18 is formed on the side of the directional nozzle 15 to which the cable 2 is attached. Two ears 19 extend out of the top of the directional nozzle 15 as shown. These ears bolt the reverse thrust cap 20 in place (see FIG. 2). The directional nozzle 15 is designed to pivot side to side around the adapter ring 5. By pulling or pushing the cable 2, the directional nozzle 15 moves right or left. If this is done while the motor is operating, the movement of the directional nozzle 15 will cause the boat to steer left or right while the motor remains stationary.

Figure 6:
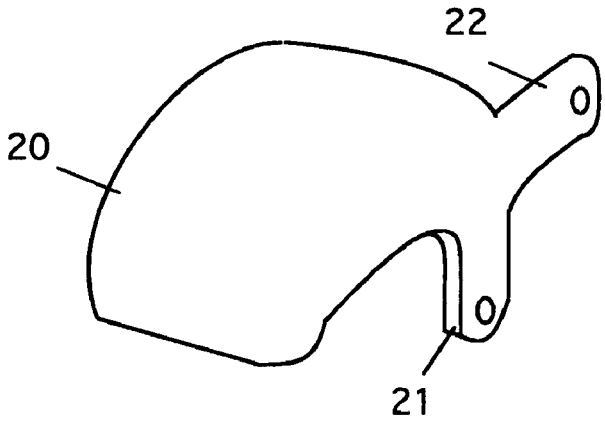
FIG. 6 is a perspective detail view of the reverse thrust cup of the jet pump steering system.

FIG. 6 is a perspective detail view of the reverse thrust cup 20 of the JPS system. In a jet drive boat, there is no propeller to reverse to reverse the thrust of the motor. Thus, the reverse thrust cup 20 is designed to move down over the output of the directional nozzle 15, which causes the jet output to strike the reverse thrust cup 20, which causes the boat to move in the reverse direction of normal thrust. The reverse thrust cup 20 is a curved member that has a pair of brackets 21 (see FIG. 3), which hook over the ears 19 on the directional nozzle 15. This allows the reverse thrust cup 20 to move in a vertical direction, up and down. The reverse thrust cup 20 is controlled by the cable 3 (see FIG. 2), which is secured to a bracket 22 that extends back from the reverse thrust cup 20 as shown. This, if cable 3 is pulled, the reverse thrust cup 20 is pulled up, which is the normal operating position. If cable 3 is pushed, the reverse thrust cup 20 is moved down into the reverse position.

In the preferred embodiment, there are two types of controls disclosed. The choice of control depends on a number of factors, including the size of the motor, the size of the boat, and the personal preferences of the operator. It is also possible to have both control systems installed and available for use on a single boat.

Figure 7:
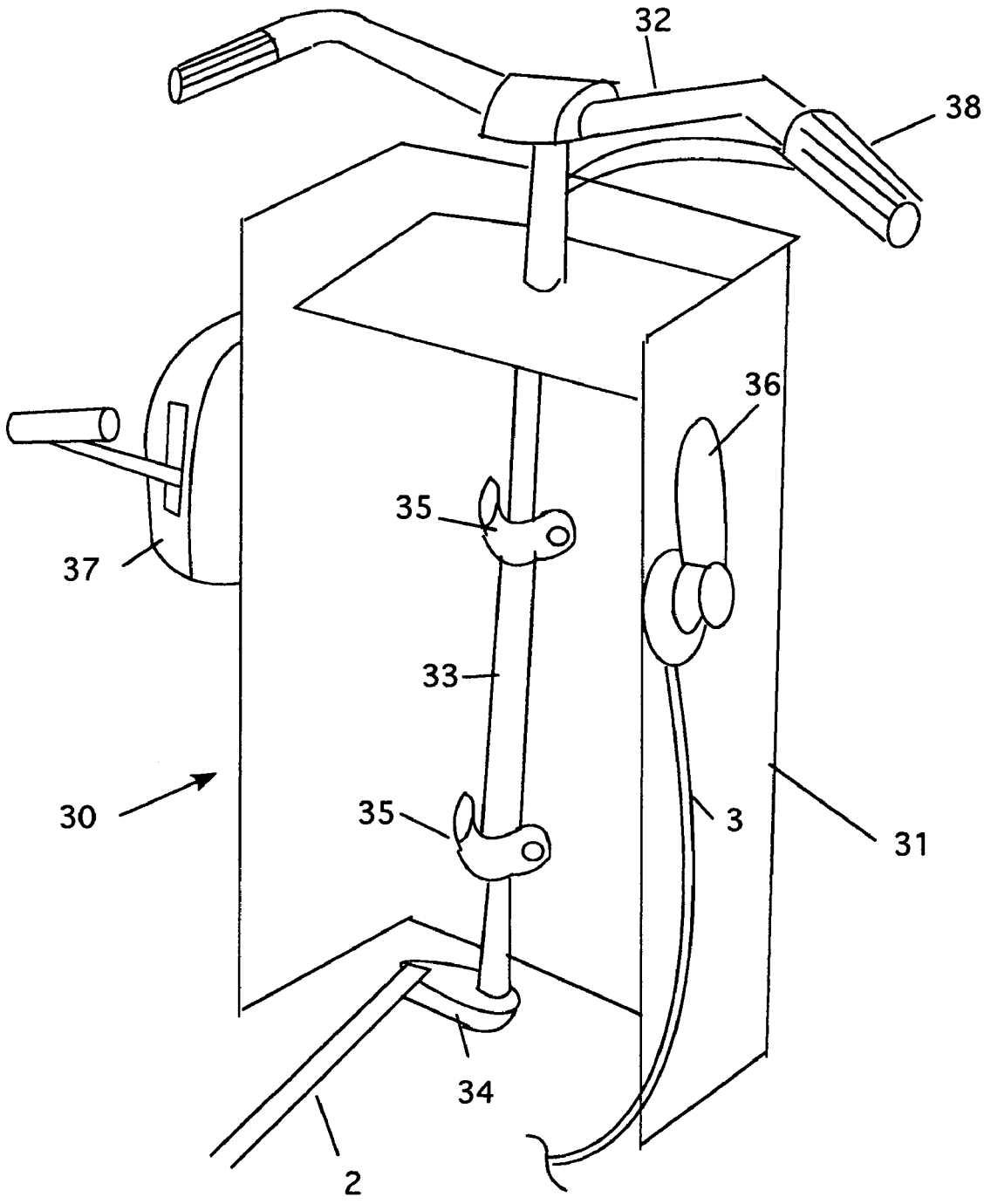
FIG. 7 is a perspective view of a handlebar steering control portion of the system.

FIG. 7 is a perspective view of a handlebar steering control portion 30 of the system. The handlebar steering control portion 30 consists of a support stand 31 that holds the unit in a convenient position and height for the user. The control has a handlebar portion 32 that is attached to a shaft 33. The shaft extends down through the support stand 31 until it connects to a horizontal connector 34. The connector 34 attached to cable 2 and to the shaft 33 such that as the shaft 33 is turned, it acts to pull or push the cable 2, which in turn, causes the directional nozzle 15 to turn, thereby steering the boat. The shaft is secured within the support stand by brackets 35 as shown. Of course, other means may be used in place of these brackets as well.

The reverse thrust handle 36 is attached to the support stand as shown. A lever connects to the cable 3 and operates the reverse thrust cup 20 by moving the lever back and forth. A speed control 37 can also be connected to the support stand as shown. Moreover, the speed control can be incorporated into one of the handles 38 of the handlebar 32. In this case, the speed control operates as the speed control on a motorcycle, or the tiller control, discussed below.

Figure 8:
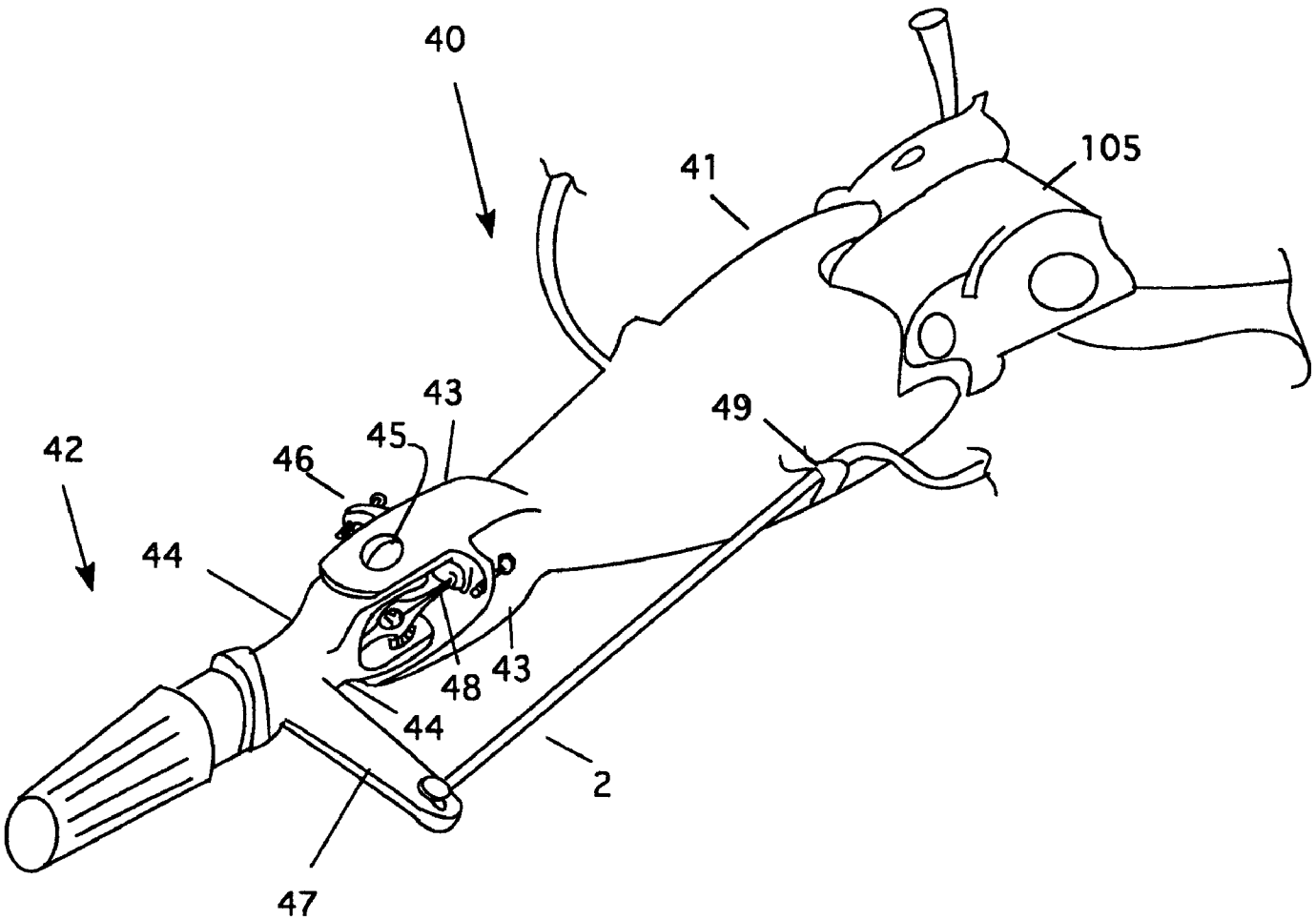
FIG. 8 is a perspective detail view of the steering tiller for the new steering system.

Ordinarily, the tiller is attached to the motor so that as the tiller is pushed from side to side, the motor is turned. The steering tiller for the instant invention, however, has a different structure. FIG. 8 is a perspective detail view of the steering tiller for the new steering system. In this system, the steering tiller 40 has a mounting arm 41, which is secured to the motor tiller mount 105. At the front of the mounting arm 41 is the steering control 42. As discussed below, the steering control 42 is attached to the mounting arm by two brackets 43 located on the mounting arm and two brackets 44 that are attached to the steering control 42. The brackets 43 and 44 are secured by fasteners 45. Linked in this way, the steering control is able to move back and forth while the mounting arm 41 remains stationary. Two adjustable stops 46 are attached to the steering control as shown. These stops limit the side-to-side movement of the steering control to a preferred range of 45 degrees of movement on each side of the centerline of the mounting arm. The stops are adjustable so that this angle can be set within a narrow range. A lever 47 is attached to the steering control as shown. Control cable 2 is attached to the lever 47. Now, as the steering control is moved from side to side, cable 2 causes the directional nozzle 15 to move from side to side. In this way, the boat can be steered using the tiller in much the same fashion as a standard tiller.

Throttle control is obtained by a universal joint 48, which allows the throttle mechanism to turn regardless of the position of the steering control 42.

In this embodiment, the reverse mechanism is handled by a lever attached to the motor, in much the same way as a normal reverse lever is used. Here, however, the reverse lever is connected to cable 3, which operates the reverse thrust cup 20. A cable stabilizer bracket 49 may be attached to the mounting arm 41 to support the cable 3 in a non-obstructive position.

Figure 9:
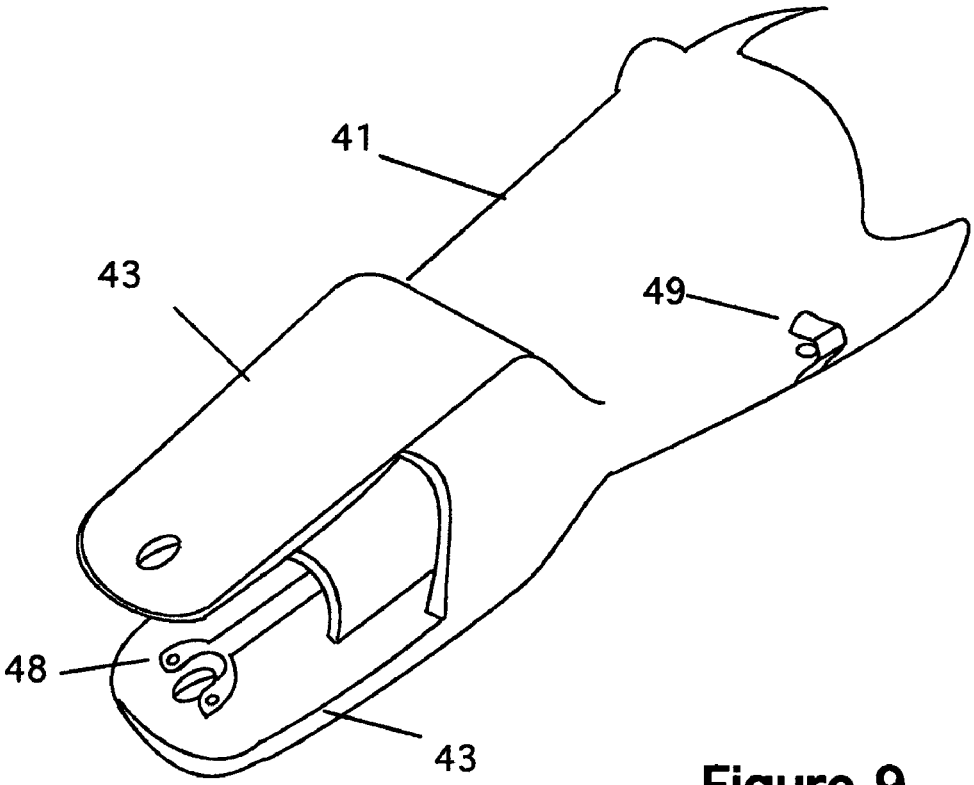
FIG. 9 is a detail view of a portion of the fixed portion of the tiller arm.

FIG. 9 is a detail view of a portion of the mounting arm 41. Here, the brackets 43 are shown as well as one-half of the universal joint 48. The cable stabilizer bracket 49 is also shown.

Figure 10:
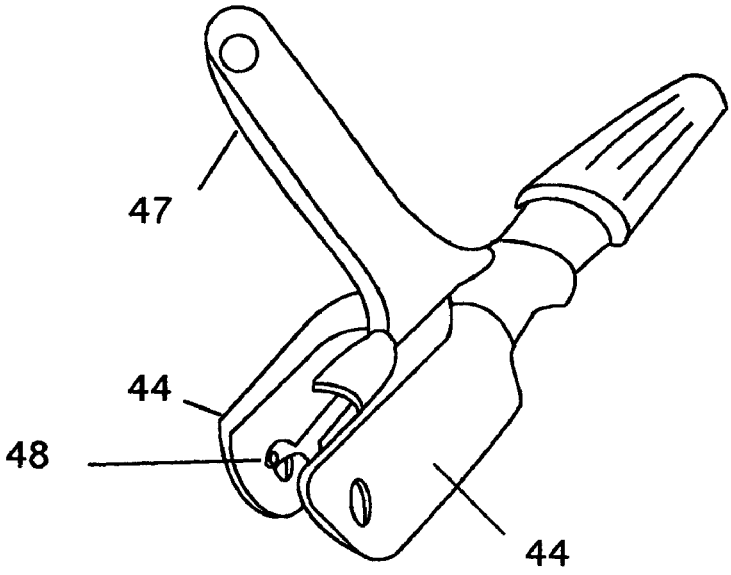
FIG. 10 is a detail view of the movable portion of the tiller arm.

FIG. 10 is a detail view of the steering control 42. This view shows the two brackets 44 that are attached to the steering control 42, as well as the lever 47, which is attached to the steering control as shown. This view also shows the other half of the universal joint 48.

Figure 11:
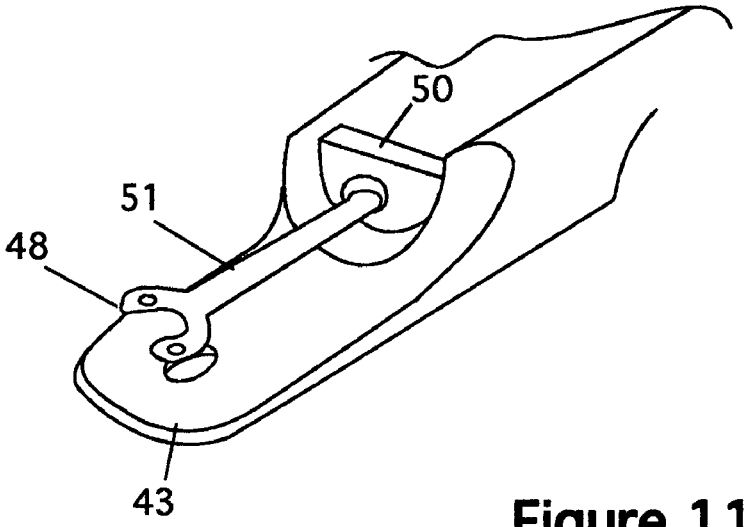
FIG. 11 is a detail view of the underside of the fixed portion of the tiller arm.

FIG. 11 is a detail view of the underside of the mounting arm 41. Note that a bearing 50 is installed on the underside of the arm to support the shaft 51 from the universal joint 48. Note that only one of the brackets 43 is shown in this view to allow the bearing 50 to be seen.

Figure 12:
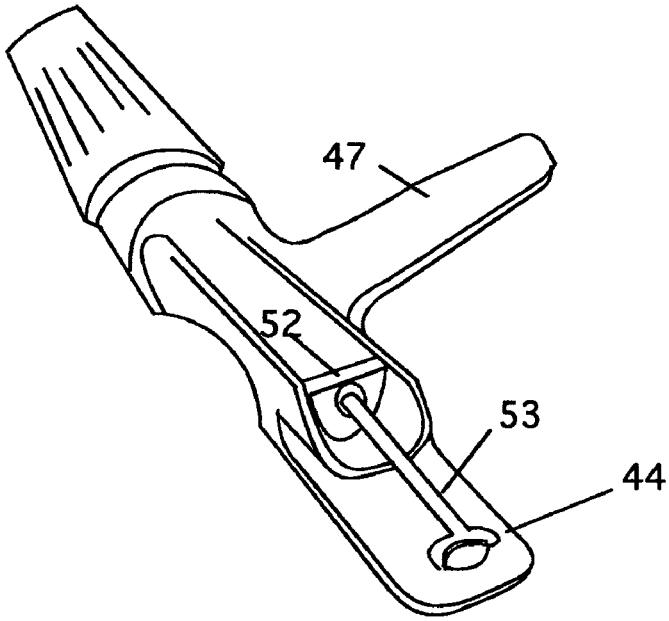
FIG. 12 is a detail view of the underside of the movable portion of the tiller arm.

FIG. 12 is a detail view of the underside of the steering control 42. As in FIG. 11, only one bracket 44 is shown. This allows the bearing 52 to be seen. This bearing supports the shaft 53 extending from the universal joint.

Figure 13:
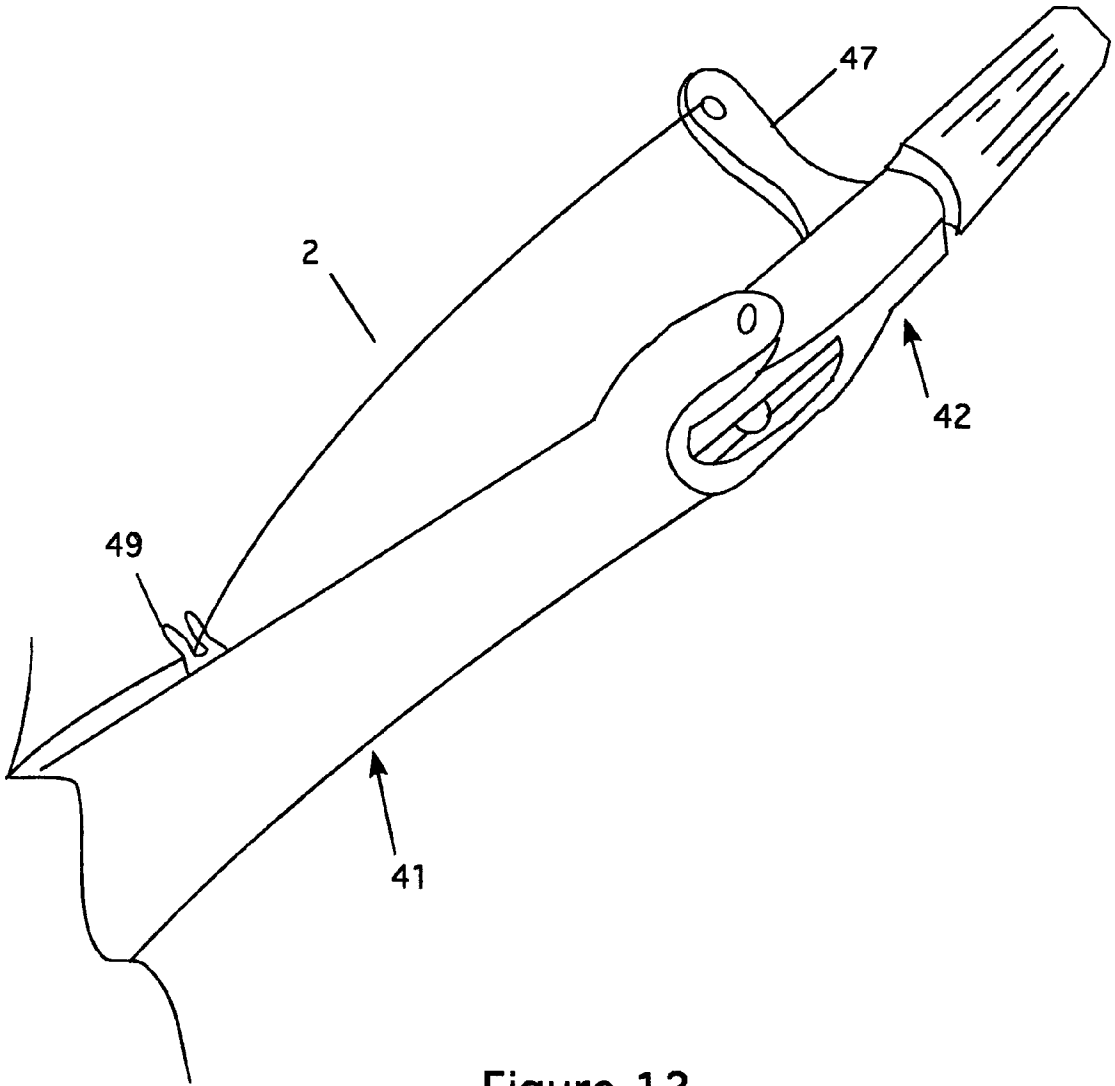
FIG. 13 is a perspective view of another embodiment of the tiller arm.

FIG. 13 is a perspective view of the modified tiller arm. In this view, the cable 2 is shown connecting to the lever 47. The cable 2 is also shown passing through another type of cable stabilizer bracket 49.

Figure 14:
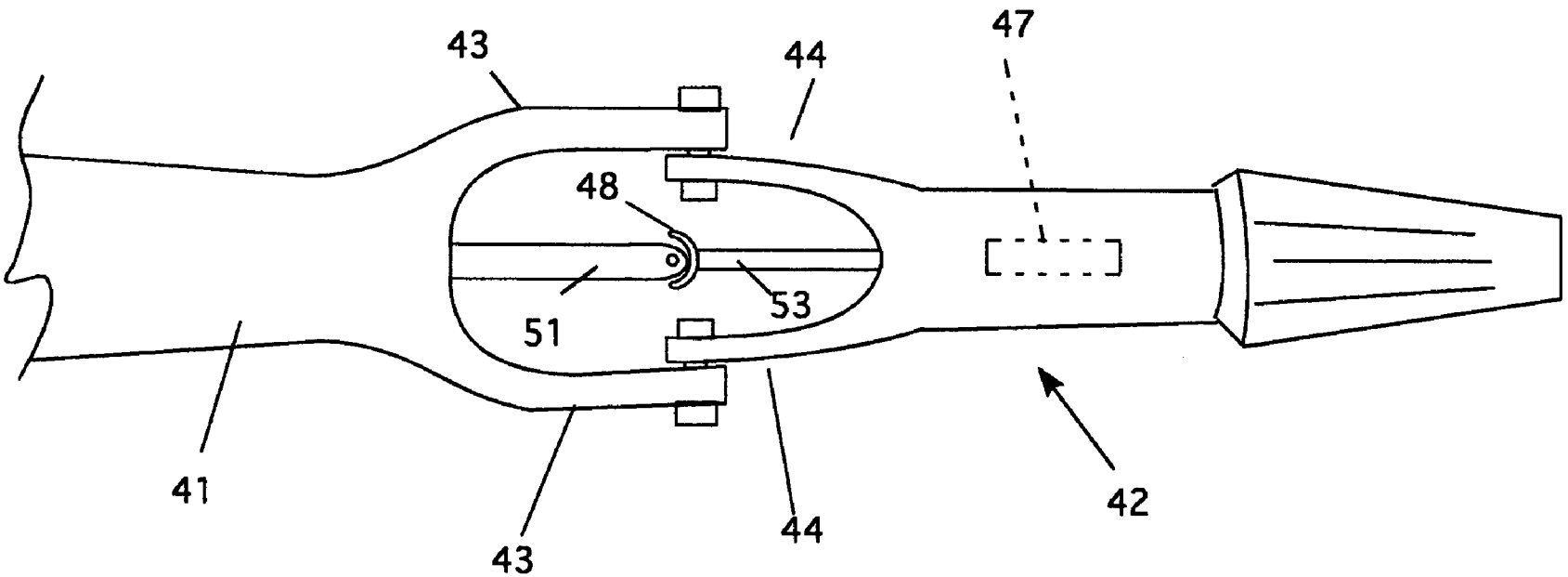
FIG. 14 is a bottom view of the embodiment of the tiller arm of FIG. 13.

FIG. 14 is a bottom view of the embodiment of the tiller arm of FIG. 13. This view shows the lever 47 and the universal joint 48 and the shafts 51 and 52.

In normal operation, the device is operated much like a traditional steering system for a boat. In the case of the tiller, the operator holds the end of the tiller in the same manner as one would use a standard outboard motor tiller. The throttle is connected to the handgrip and is operated by twisting the handgrip. The boat is steered by moving the end of the tiller back and forth in a horizontal plane. Unlike the standard tiller, which when moved causes the entire motor to turn; the tiller of the instant invention causes the directional nozzle to move back and forth, which causes the boat to turn without moving the motor. In the case of the handlebar steering, turning the handlebars causes the cable to move the directional nozzle, thereby turning the boat. Again, the motor is not moved and the turning action does not require many rotations of a steering wheel.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A steering system for a boat having an outboard motor with a jet drive output comprising:

a) a directional nozzle, pivotably mounted to said outboard motor such that said directional nozzle surrounds said jet drive output and extends backward therefrom;

b) a tiller handle attached to said outboard motor; and c) a means for connecting said tiller handle to said directional nozzle d) wherein said tiller handle includes:

i) a mounting arm, which is secured to the outboard motor and extends forward therefrom, said mounting arm having an upper bracket and a lower bracket;

ii) a steering control portion, having a handgrip and a steering arm, extending rearward therefrom, said steering arm having an upper bracket and a lower bracket;

iii) a fastener means for pivotably connecting the upper bracket on said mounting arm to the upper bracket of said steering arm;

iv) a fastener means for pivotably connecting the lower bracket on said mounting arm to the lower bracket of said steering arm; and v) a cable connector, attached to said steering arm.

2. The steering system of claim 1 wherein the tiller handle further comprises a means for controlling the speed of the outboard motor.

3. The steering system of claim 2 wherein the means for controlling the speed of the outboard motor includes:

a) a twisting hand grip;

b) a shaft attached to said twisting handgrip and extending backwards therefrom;

c) a universal joint attached to said shaft;

d) a second shaft attached to said universal joint and extending backwards therefrom; and e) a means for connecting said second shaft to a throttle, in operable communication with said outboard motor.

* * * * *